US005771945A

United States Patent [19]

Jenner et al.

[11] Patent Number: 5,771,945

[45] Date of Patent: Jun. 30, 1998

[54] WIRE PREPARATION TOOL

[75] Inventors: Royal Jenner, Tinley Park; Larry A. Hillegonds, New Lenox, both of Ill.

[73] Assignee: Panduit Corp., Tinley Park, Ill.

[21] Appl. No.: 827,113

[22] Filed: Mar. 26, 1997

[51] Int. Cl.[6] ..... B21F 11/00

[52] U.S. Cl. ..... 140/123; 140/147; 269/903

[58] Field of Search ..... 248/68.1; 140/123, 140/147, 92.1; 269/903; 24/129 R, 129 D, 130; 83/200, 452, 460; 29/749, 755

[56] References Cited

U.S. PATENT DOCUMENTS

| | | |
|---|---|---|
| 3,588,932 | 6/1971 | Sedlacek . |
| 3,736,606 | 6/1973 | Raum et al. . |
| 3,875,601 | 4/1975 | Kaufman . |
| 3,880,022 | 4/1975 | Miller . |
| 4,027,368 | 6/1977 | Asick . |
| 4,116,092 | 9/1978 | Wheeler . |
| 4,152,797 | 5/1979 | Wells, Jr. . |
| 4,188,841 | 2/1980 | Nakamura et al. . |
| 4,194,256 | 3/1980 | Knickerbocker . |
| 4,620,573 | 11/1986 | Meder . |
| 4,674,669 | 6/1987 | Kozyrski et al. . |
| 5,435,029 | 7/1995 | Carlson, Jr. et al. . |
| 5,507,207 | 4/1996 | Benoit et al. . |

*Primary Examiner*—Lowell A. Larson
*Attorney, Agent, or Firm*—Mark D. Hilliard; Robert A. McCann; Michael J. Turgeon

[57] ABSTRACT

A wire preparation tool comprising a planar base member with two adjacent projections extending upwardly at one end of the base, a wire path defined between the projections and a plurality of wire grooves disposed below the wire path.

12 Claims, 7 Drawing Sheets

WIRE PREPARATION TOOL

TECHNICAL FIELD

The present invention relates to a wire preparation tool and more particularly to a hand-held, inexpensive, simple-to-use tool which enhances the tool-operator's ability to properly position and arrange twisted pair wire of Catagory 5 cable for presentation, placement and crimping in a corresponding connector, such that the twists in the wires are as close as possible to the connector.

BACKGROUND OF THE INVENTION

In the telecommunication and electronic industry, equipment performance has significantly increased to a level identified as Category 5. This level of performance is due in large measure to the need for increased data transmission rates requiring improved connecting devices, or hardware, which may include plugs, jacks and patch panels.

The Telecommunications Industry Association (TIA) in cooperation with the Electronic Industries Association (EIA) has developed a proposed standard for Catagory 5 components, where the transmission requirements of such components are characterized up to 100 MHz and are typically intended for energizing applications with transmission rates up to 100 Mbps. It is important to note that the hardware is only one major element of a communication system, another major component is the transmission cable. Such cables are typically high performance unshielded twisted pair (UTP) cables. Until recently, cable performance development outdistanced the hardware capable of transferring error-free data at such high rates of speed. For example, the demand for higher and higher frequency transmission rates resulted in some cables exceeding the Catagory 5 standard by a sizable margin, namely the Berk-Tek LANmark-350 cable. However, now there are also many connectors which exceed the Catagory 5 performance standard, therefore it is very important to correctly field connect the hardware to the cable such that the transmission characteristics are not degraded by wire twists not being close to the connector.

Two important test parameters for high performance data transmission, i.e., Category 5, are Attenuation and Near-End Cross-Talk (NEXT) Loss. Attenuation may be defined as a measure of signal power loss due to the connecting hardware and is derived from swept frequency voltage measurements on short lengths of 100-ohm twisted pair test leads before and after splicing-in the connector under test.

Near-end crosstalk loss may be defined as a measure of signal coupling from one circuit to another within a connector and is derived from swept frequency voltage measurements on short lengths of 100-ohm twisted pair test leads terminated to the connector under test. NEXT loss is the way of describing the effects of signal coupling causing portions of the signal on one pair to appear on another pair as unwanted noise.

In view of these types of errors above, the connector/cable interface is of utmost importance with regard to data transmission performance. However, the physical difficulty of placing pre-cut wires in their respective termination slots while maintaining pair twists as close as possible to the point of termination, as is necessary to achieve Catagory 5 performance, made previous attempts at field termination impractical.

The prior art of field wiring termination tools encompasses cutting tools, cutting and stripping tools and Catagory 5 sheath cutting and twisted pair separating or flattening tools as disclosed in U.S. Pat. No. 5,435,029 to Carlson, Jr. et al. However, none of the tools of the prior art enhance the tool operator's ability to field terminate Catagory 5 connectors. Carlson, Jr. et al. teaches how to expose and separate the twisted pair wires, but the problem remains with inserting or placing the individual wires into the respective termination slots while maintaining pair twists as close as possible to the point of termination.

Therefore, it will be appreciated that there is a need for a hand-held tool which enhances the practicability of field terminating of Catagory 5 connectors by properly organizing the wires for placement within connector termination slots and maintaining wire pair twists as close as possible to the point of termination.

SUMMARY OF THE INVENTION

It is therefore an object of the present invention to provide an improved wire preparation tool.

It is a further object of the present invention to provide a wire preparation tool which appreciably enhances field termination capability.

It is a still further object of the present invention to provide a simple, inexpensive wire preparation tool which correctly arranges and positions twisted pair wire for insertion into a connector.

It is a still further object of the present invention to provide a wire preparation tool which maintains wire pair twists as close to the point of termination as possible.

It is a still further object of the present invention to provide a wire preparation tool which may have a twisted pair wire separator.

In general, a wire preparation tool according to the present invention includes a planar base member with two adjacent projections extending upwardly at one end of the base, a wire path defined between the projections and at least one wire groove disposed below the wire path. Another version of the wire preparation tool may include a twisted pair wire separator projection and corresponding thumb guard, in addition to the tool components described above.

DESCRIPTION OF THE PREFERRED EMBODIMENT

Figure 1:
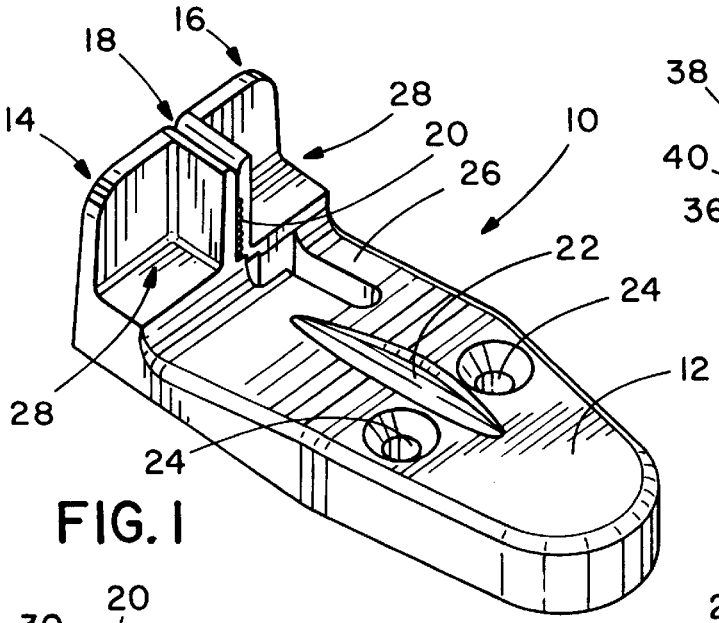
FIG. 1 is a top perspective view of the wire preparation tool in accordance with the present invention.

A wire preparation tool embodying the concept of the present invention is designated generally by the reference numeral 10 in the accompanying drawings. As shown in FIG. 1, the wire preparation tool 10 is a one-piece tool with several integral parts, such as, a base member 12, spring leg 26, vertically extending projections 14 and 16, a wire path 18, wire grooves 20, cable guide 22 and finger reliefs 28.

As seen in FIGS. 1–5, the planar base member 12 is the foundation of the tool 10 which has been shaped and contoured for easy handling and efficient use when assembling Catagory 5 connectors. Preferably, at least a pair of bores 24 extend through the base 12 for attachment purposes. The tool 10 may then be mounted to any desired planar surface via conventional fasteners (not shown) extending through the bores 24, or attachment to a tool operator via a ring-type device (not shown). Further, a cable guide 22 is formed in a central location on the base 12 and extends a distance along a portion of the tool 10 longitudinal axis. A cable sheath may preferably be disposed within the cable guide 22 when wires are prepared for termination, as will be explained in detail below.

Figure 2:
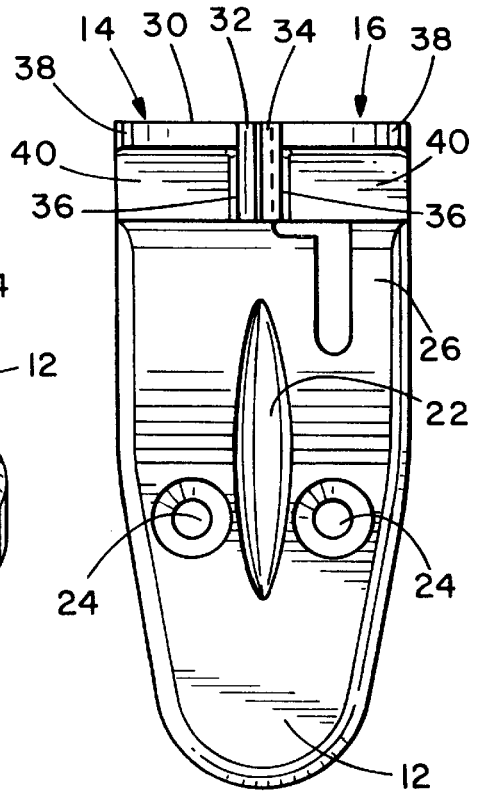
FIG. 2 is a top view of the wire preparation tool of FIG. 1.
Figure 3:
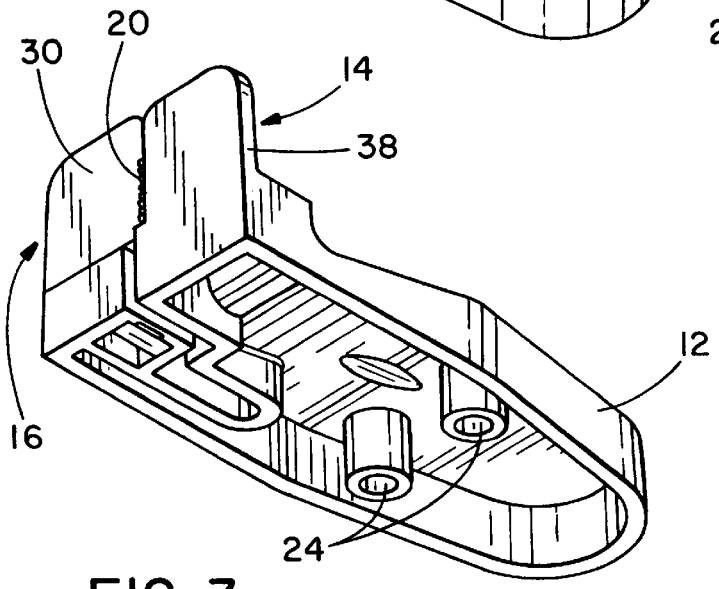
FIG. 3 is a bottom perspective view of the wire preparation tool of FIG. 1.
Figure 7:
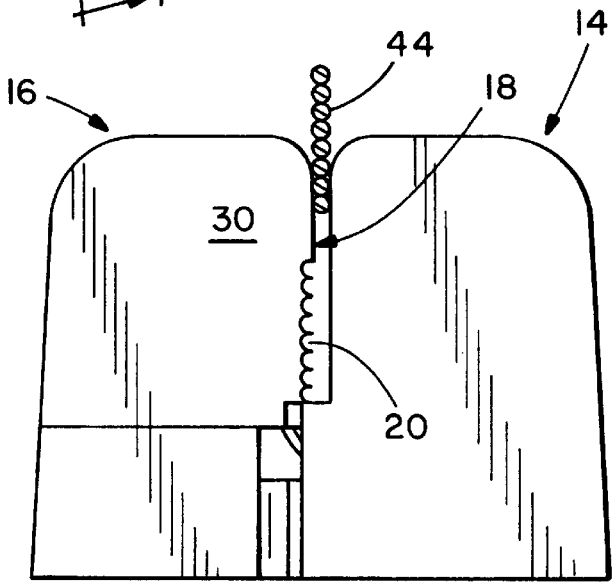
FIG. 7 is sectional view along the line 7—7 of FIG. 6.
Figure 8:
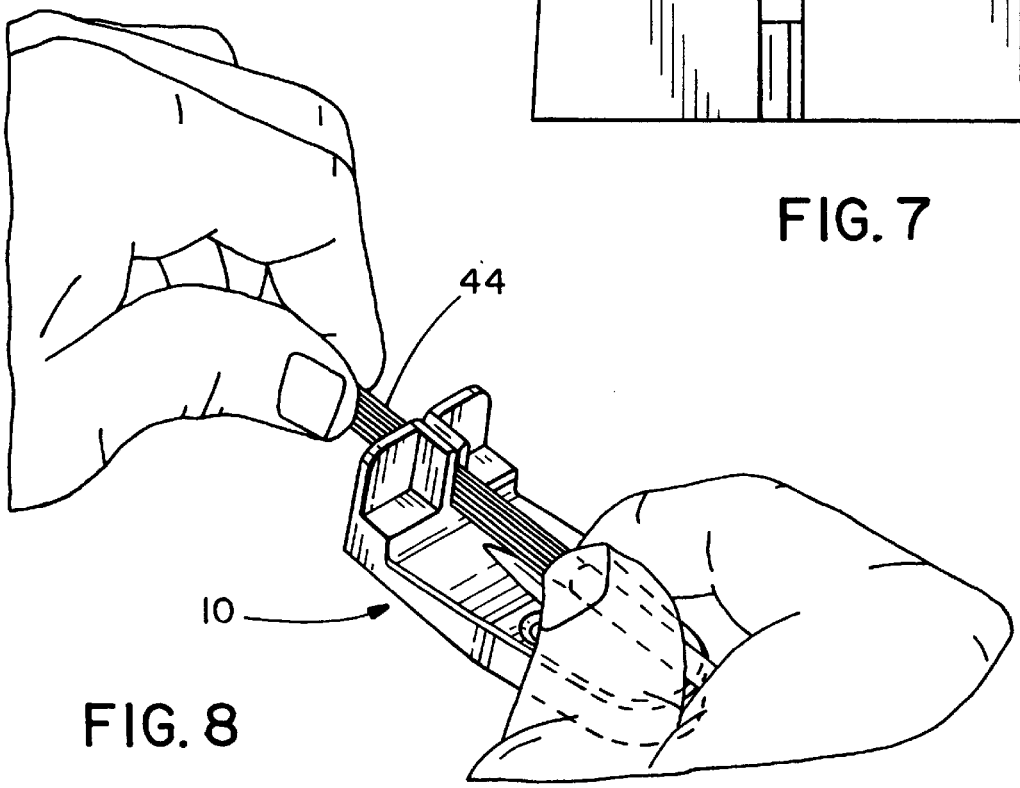
FIG. 8 is a perspective view of a tool operator inserting a prearranged set of wires down into the wire grooves.
Figure 10:
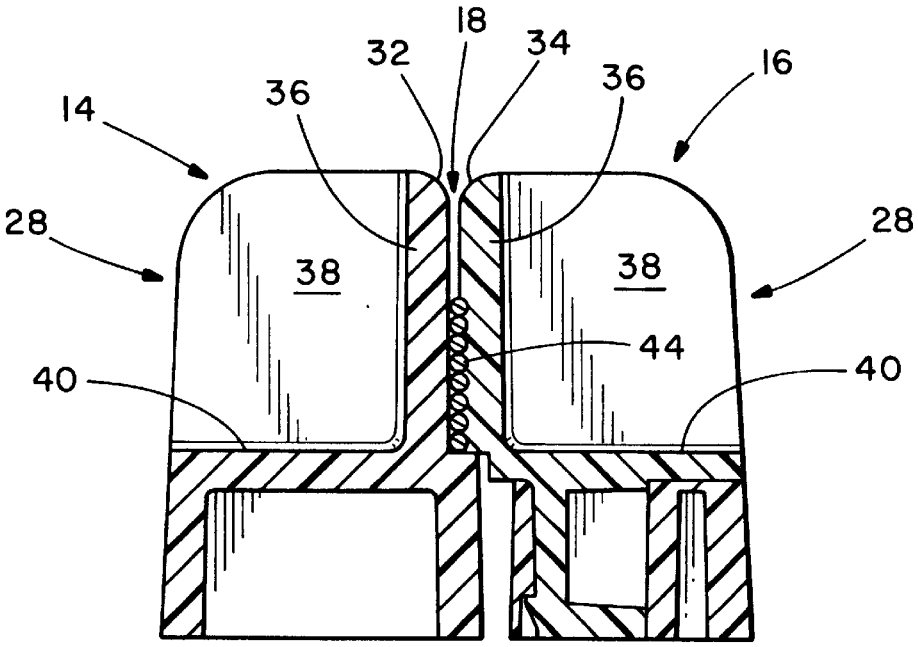
FIG. 10 is a sectional view along the line 10—10 of FIG. 9.

As seen in FIGS. 1–3, the spring leg 26 preferably extends from the base 12 to permit projection 16 to be laterally displaced slightly away from projection 14 when a wire 44 passes through the wire path 18, as shown in FIG. 7. As a result, projection 16 is biased against projection 14 to adequately secure the wires 44 within the wire grooves 20, as shown in FIGS. 8 and 10. However, the spring leg 26 is not required for the present invention.

Figure 4:
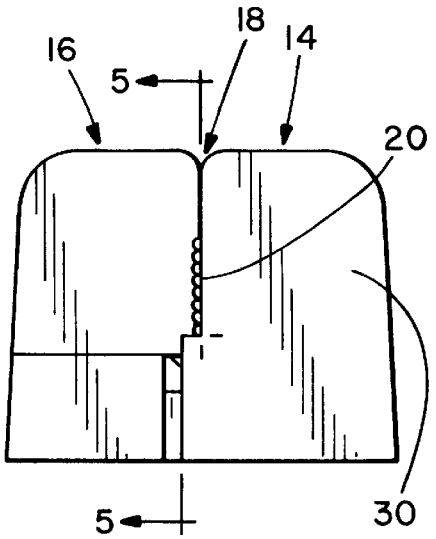
FIG. 4 is a back view of the wire preparation tool of FIG. 1.
Figure 5:
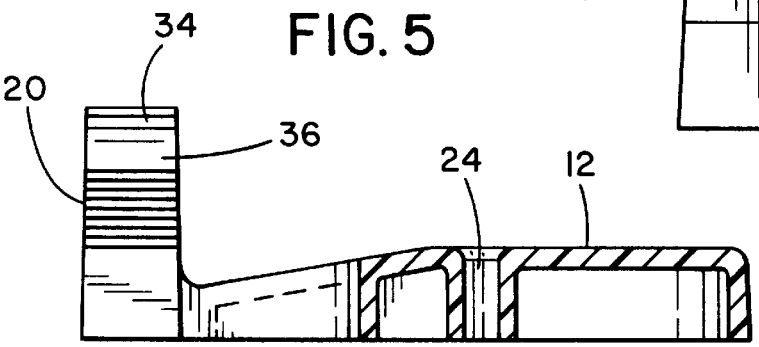
FIG. 5 is a sectional view along the line 5—5 of FIG. 4.
Figure 6:
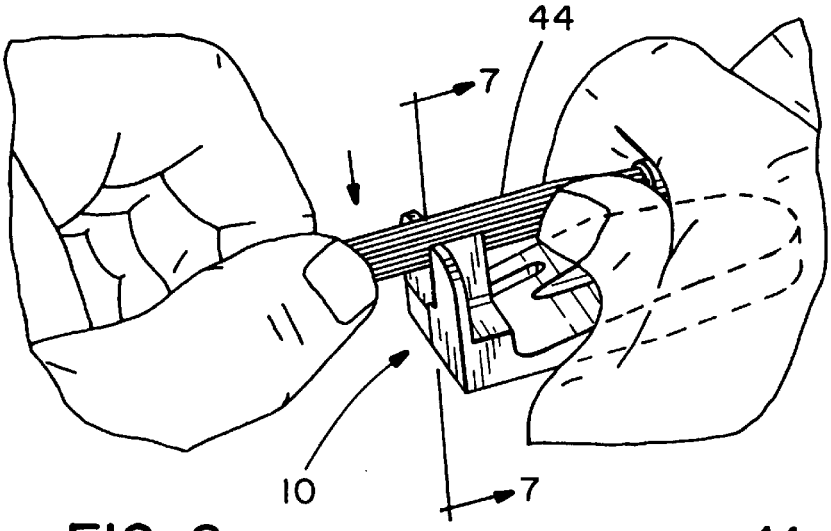
FIG. 6 is a perspective view of a tool operator inserting a prearranged set of wires down into the wire path.

As best seen in FIGS. 3–5, two projections 14 and 16 extend vertically upward from the base 12, and each projection generally mirrors the other in construction. As generally described above, projection 16 is disposed at the end of the spring leg 26, and away from the base 12. Projection 14, however, is disposed at the end of the base 12 adjacent projection 16. The two projections 14 and 16 cooperate to secure and position wires during preparation for termination. Wire grooves 20 are formed in a lower extent of projection 16 for the positioning of wires, such that the grooves 20 are preferably slightly smaller than the wires of conventional Catagory 5 cable and therefore, when the spring leg 26 biases projection 16 against projection 14 the wires are secured and properly arranged therein. However, it is recognized that the wire path 18 and wire grooves 20 can be appropriately sized for any type of wire preparation.

As seen in FIGS. 1–3, a portion of each projection 14 and 16 is comprised of upright axially aligned walls 36 which define the wire path 18 therebetween. Perpendicular walls 38 extend from the distal end of the axially aligned walls 36 to a position near the outer edge of the base 12 or spring leg 26. The perpendicular walls 38 have a flat, planar backface 30 which provides an excellent guide surface with which to achieve a clean even and equal cutoff for wires as described below. Horizontal sections 40 are defined on two edges by axially aligned walls 36 and perpendicular walls 38. Disposed where the two defining walls 36 and 38 meet the base 12, the horizontal sections 40 are the final side which defines an area recognized as the finger reliefs 28.

Figure 13:
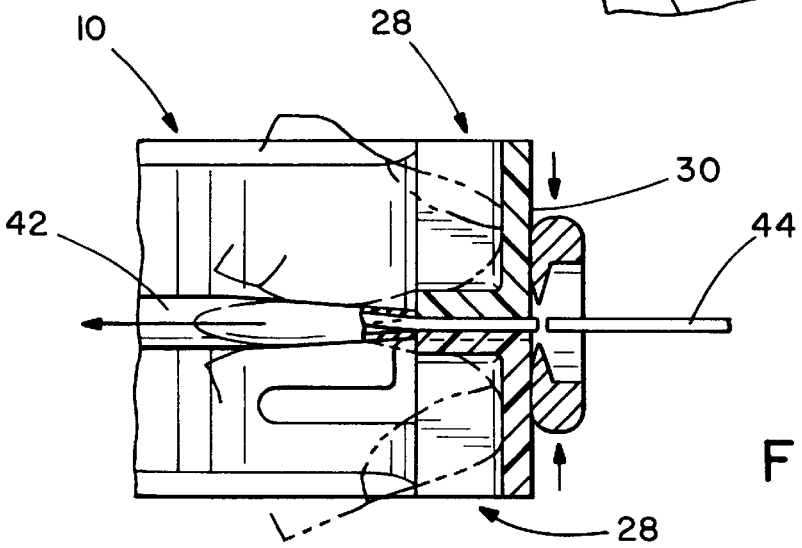
FIG. 13 is a sectional view along the line 13—13 of FIG. 12, where the wires are cut and the tool operator is ready to remove them.

Preferably formed in each projection 14 and 16, the reliefs 28 enable the tool operator to easily grasp the cable sheath 42 and wires 44 which have been cut to length and are ready for insertion into a Catagory 5 connector, as seen in FIG. 13.

As seen in FIGS. 1–3, the wire path 18 is disposed between and defined by the axially aligned walls 36 of the projections 14 and 16. Smooth, gently curving top portion 32 and 34 provide a lead-in for the wires as they are maneuvered into and through the wire path 18. Preferably, these portions 32 and 34 enable the tool operator to simply separate projection 16, which is spring biased, from projection 14 by merely inserting the wires and not requiring any additional effort or manipulation.

As seen in FIGS. 17–20, an alternative embodiment of the wire preparation tool 10 has similar construction and function, therefore the reference numerals of the primary embodiment referring to the same parts on the alternative embodiment will remain the same. Since alternative embodiment is virtually identical in construction and operation, only the additional parts will be discussed below. A separator projection 46 is disposed on the side of the base 12. If the spring leg 26 is used, the separator projection 46 would be positioned opposite thereto. The projection 46 is generally conically shaped and preferably has a well defined point. This shape has been shown to ease the untwisting function, however any suitable shape may be used. A thumb guard 48 also extends from the same side of the base 12, so as to cooperate with the separator projection 46. The preferably flat and planar guard 48 extends a certain distance away from the base 12 and separator projection 46. Disposed in such a position, the guard 48 springs back to its original position after each use. Twisted pair wire can be separated into individual wires through cooperation of projection 46 and guard 48, as will be described below.

Figure 21:
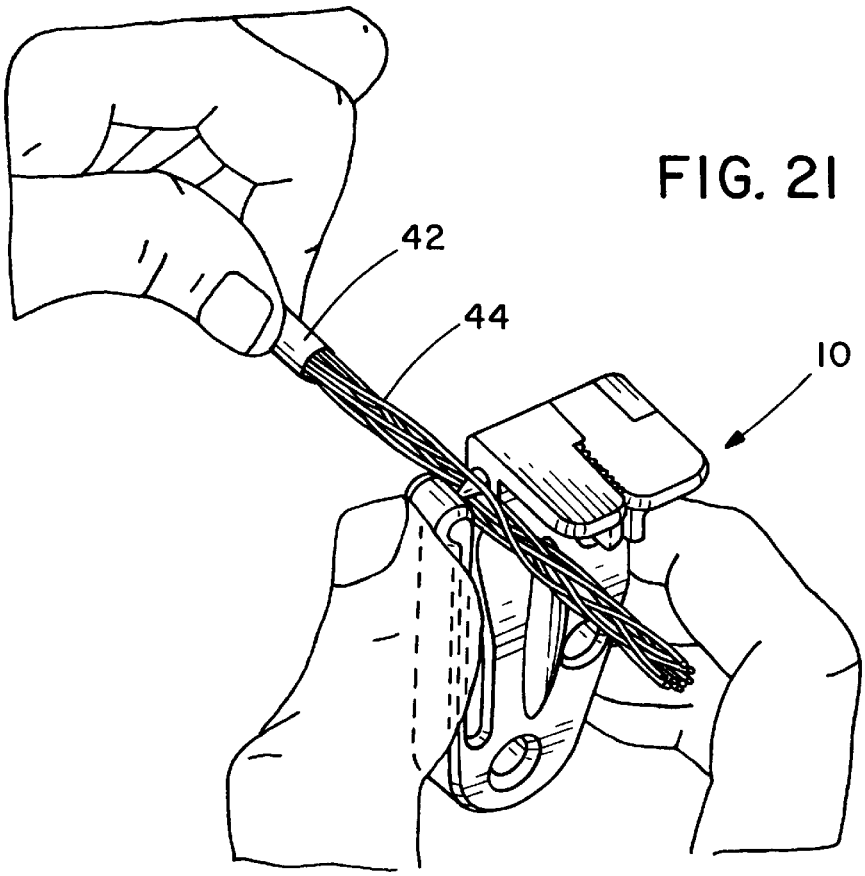
FIG. 21 is a perspective view of the tool operator separating a twisted pair wire.
Figure 22:
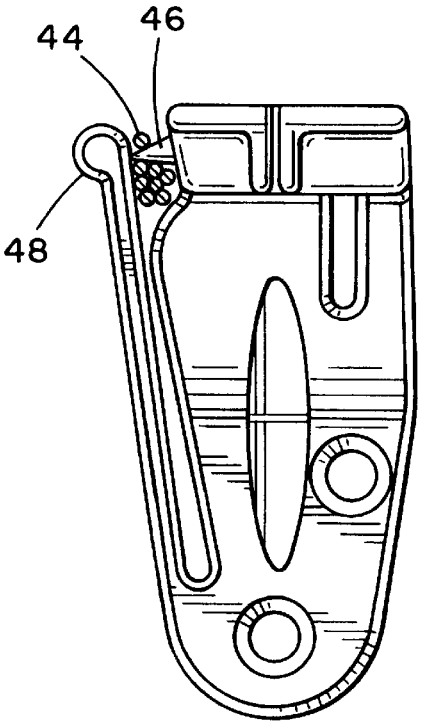
FIG. 22 is a top view of the wire separator of the alternative embodiment of the wire preparation tool separating a twisted pair wire.
Figure 23:
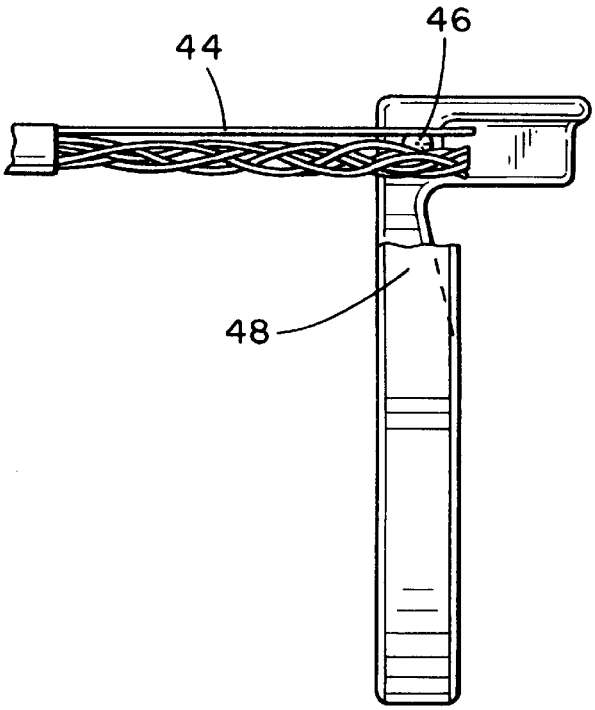
FIG. 23 is a partially cut-away side view of the wire separator of the alternative embodiment of the wire preparation tool separating a twisted pair wire.

In operation, as best seen in FIGS. 6–16, the cable sheath 42 is removed, by any conventional method, a certain portion to reveal twisted pair wire 44. The individual wires may preferably be untwisted from their corresponding pair by placing the separator projection 46 between the wires 44, depressing the thumb guard 48 and pulling the wires 44, thus untwisting them, as seen in FIGS. 21–23, or any other conventional untwisting means. All other functions of the alternative embodiment are as exact as the original embodiment, aside from the separating function listed above, and therefore will not be duplicated herein.

Figure 9:
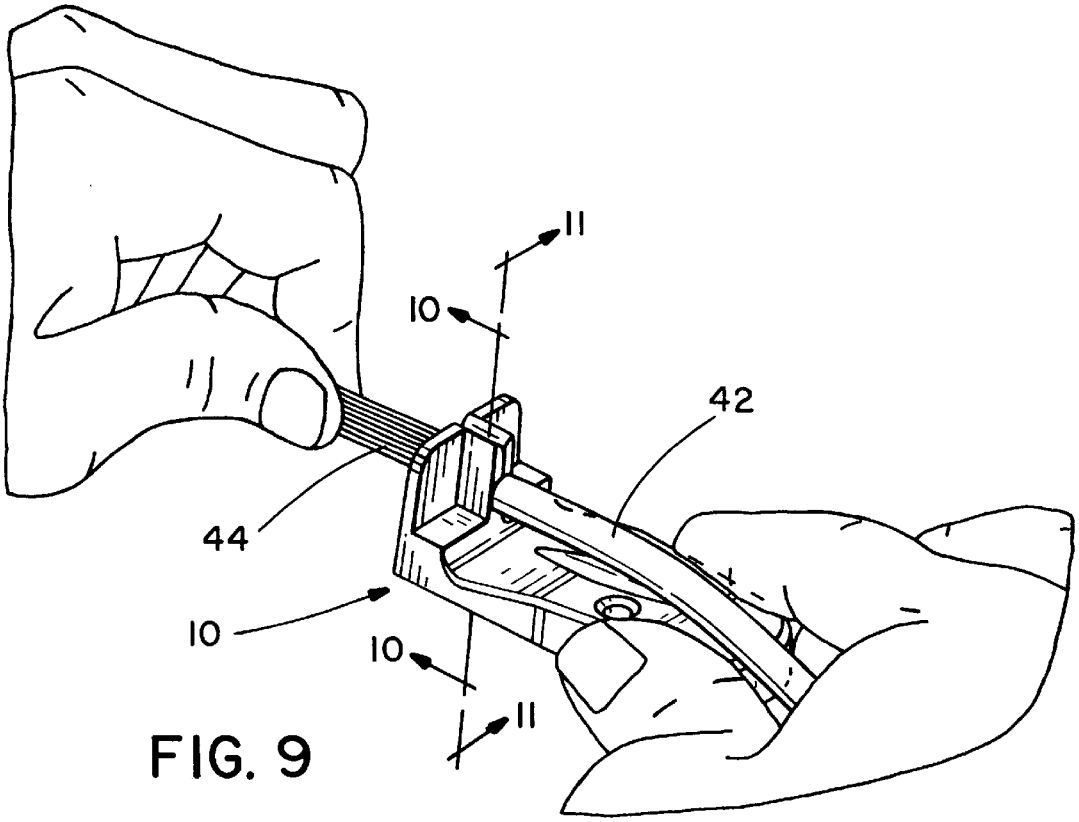
FIG. 9 is a perspective view of a tool operator pulling the prearranged wires until the cable sheath prohibits further movement.
Figure 11:
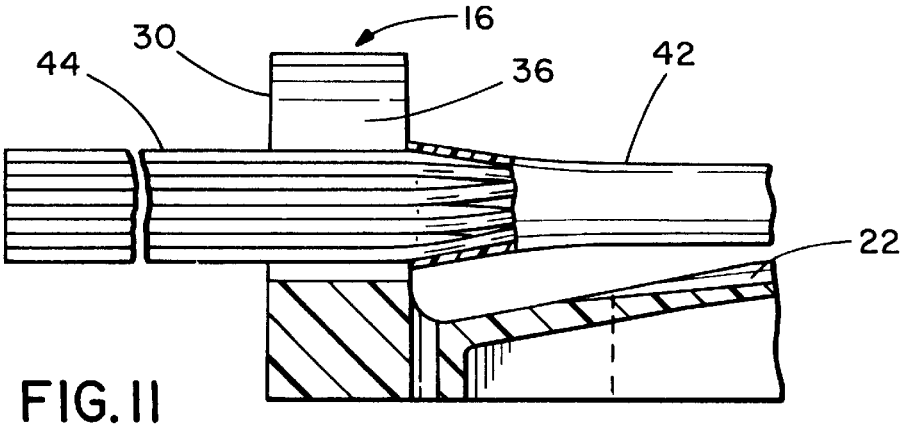
FIG. 11 is a sectional view along the line 11—11 of FIG. 9.
Figure 16:
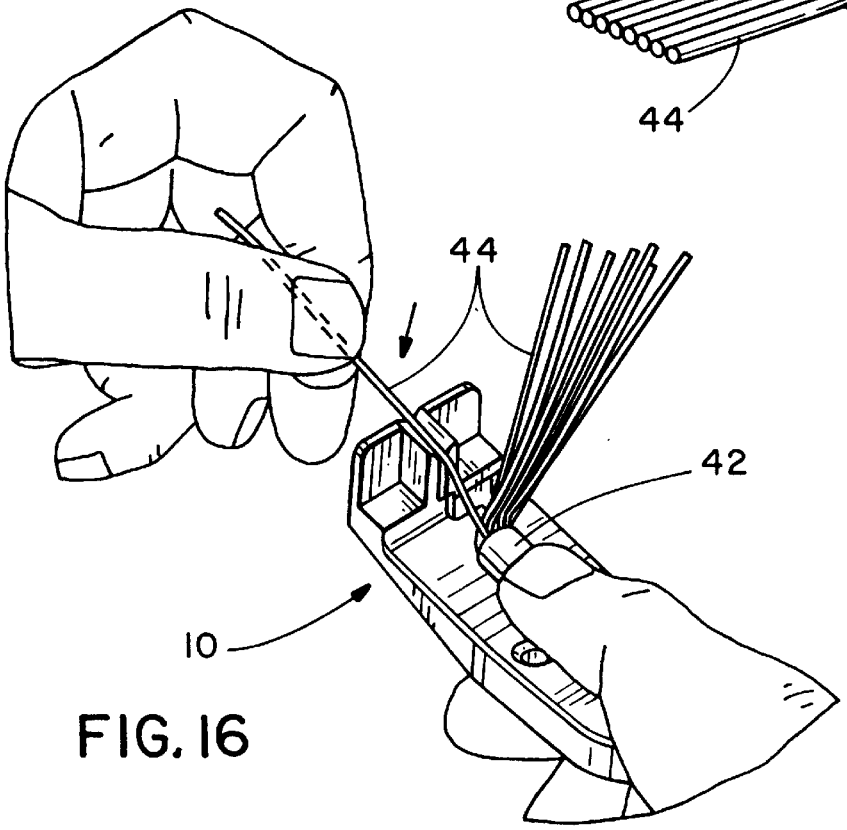
FIG. 16 is a perspective view of the tool operator inserting a single wire from an unorganized bundle into the wire path
Figure 17:
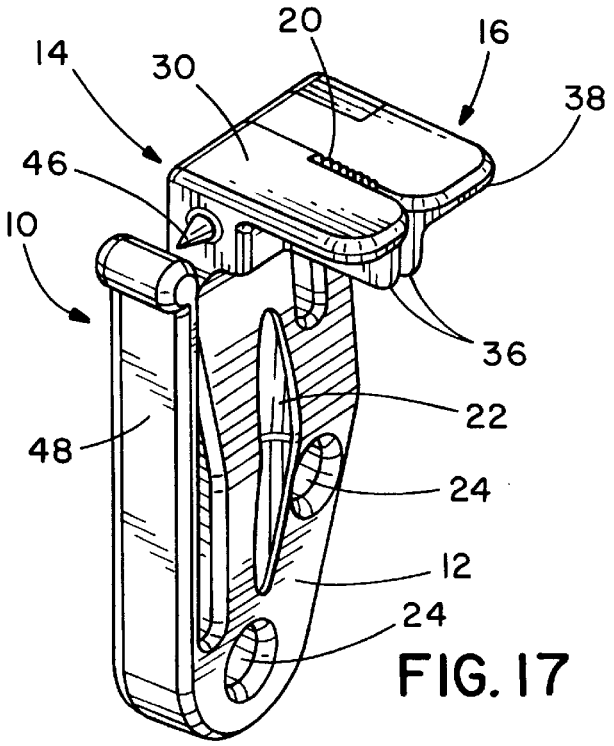
FIG. 17 is a perspective view of an alternative embodiment of the wire preparation tool of the present invention.
Figure 18:
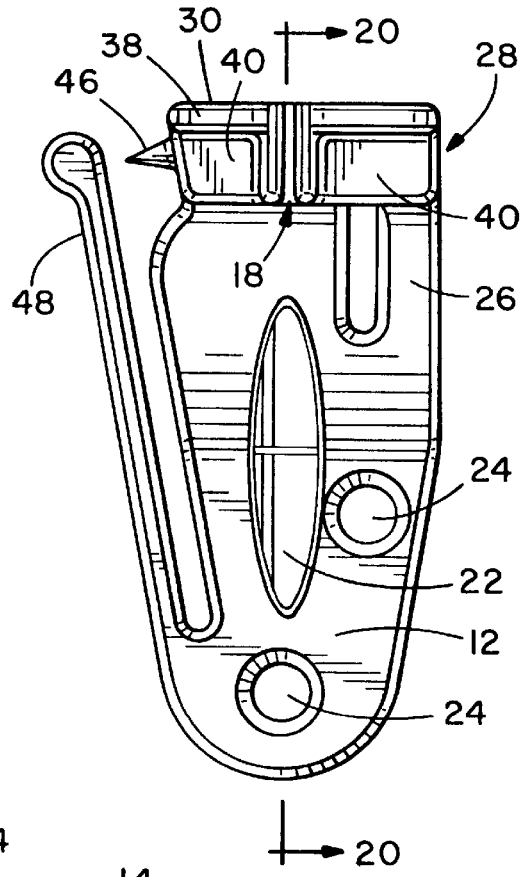
FIG. 18 is a top view of the alternative embodiment of the wire preparation tool of FIG. 17.
Figure 19:
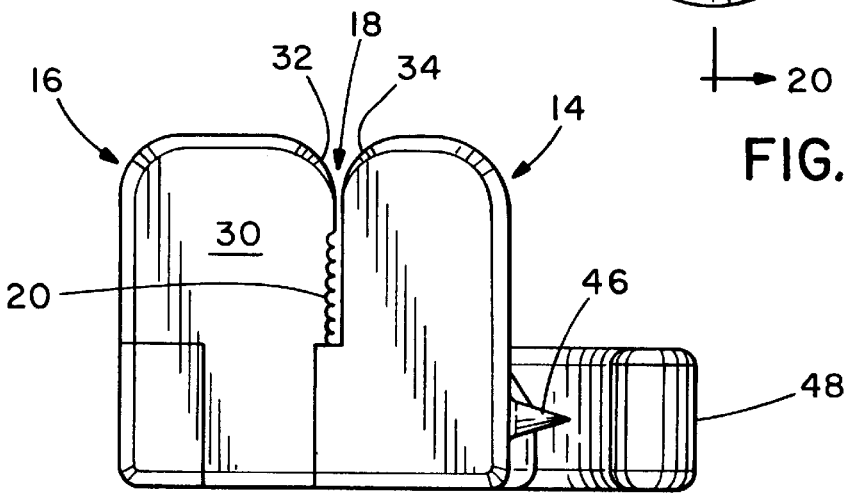
FIG. 19 is a back view of the alternative embodiment of the wire preparation tool of FIG. 17.
Figure 20:
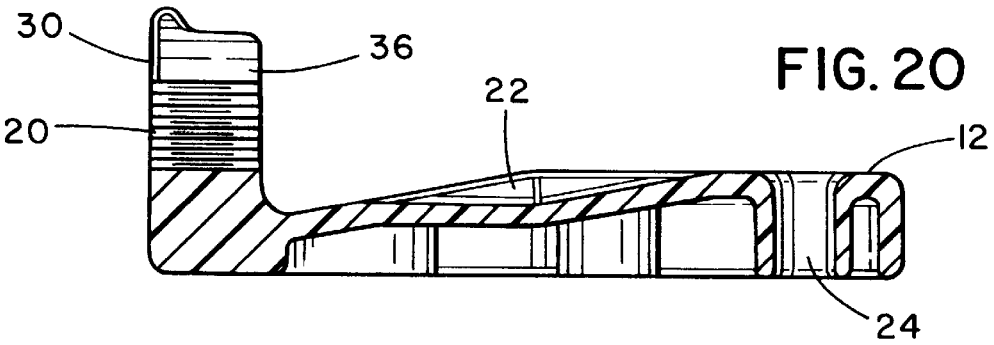
FIG. 20 is a sectional view along the line 20—20 of FIG. 18.

After the wires 44 are untwisted, the tool operator preferably arranges the wires 44 in their desired or required order, according to the Catagory 5 connector used. As seen in FIG. 16, the wires 44 may also be inserted into the tool 10 one-by-one if the tool operator so desires. The prearranged wires 44 are then inserted near the gently curved top portions 32 and 34 and into the wire path 18. As seen in FIG. 7, when the wires 44 enter the wire path 18 the spring leg 26 permits projection 16 to be displaced away from projection 14 so that the wires 44 can be further inserted into the wire path 18. As the is wires 44 are further inserted, they are then fitted into the wire grooves 20, as seen in FIGS. 8 and 10. Once the wires 44 are secured in the grooves 20, the tool operator may pull the wires 44 in the direction of their longitudinal axis until the sheath 42 prohibits further movement, as seen in FIGS. 9 and 11. This step is important because this is how the tool operator keeps the twists within the sheath as close as possible to the connector when terminated therein.

Figure 12:
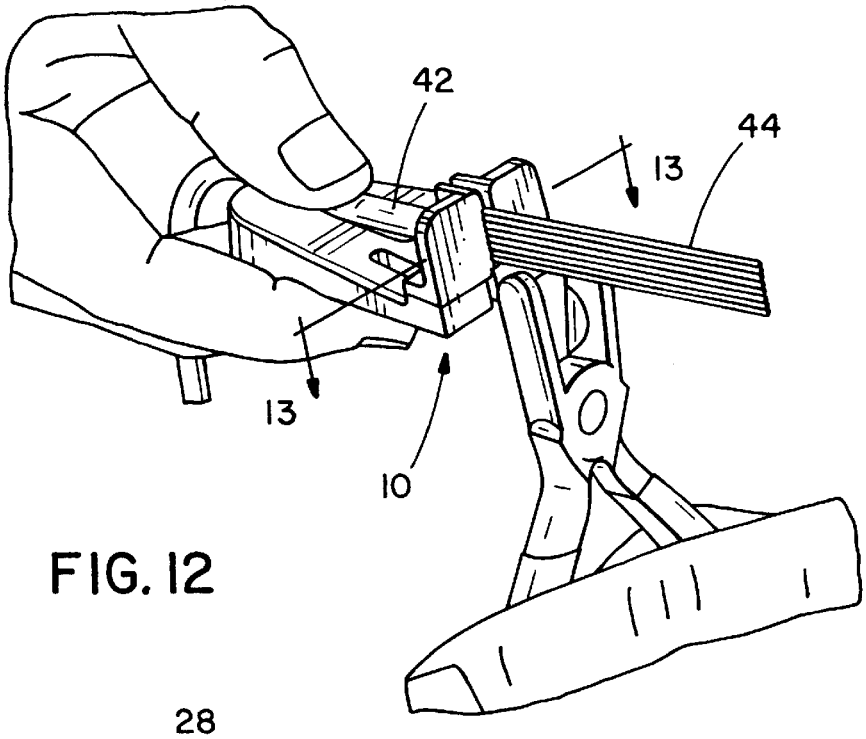
FIG. 12 is a perspective view of a tool operator preparing to cut the wires to length.
Figure 14:
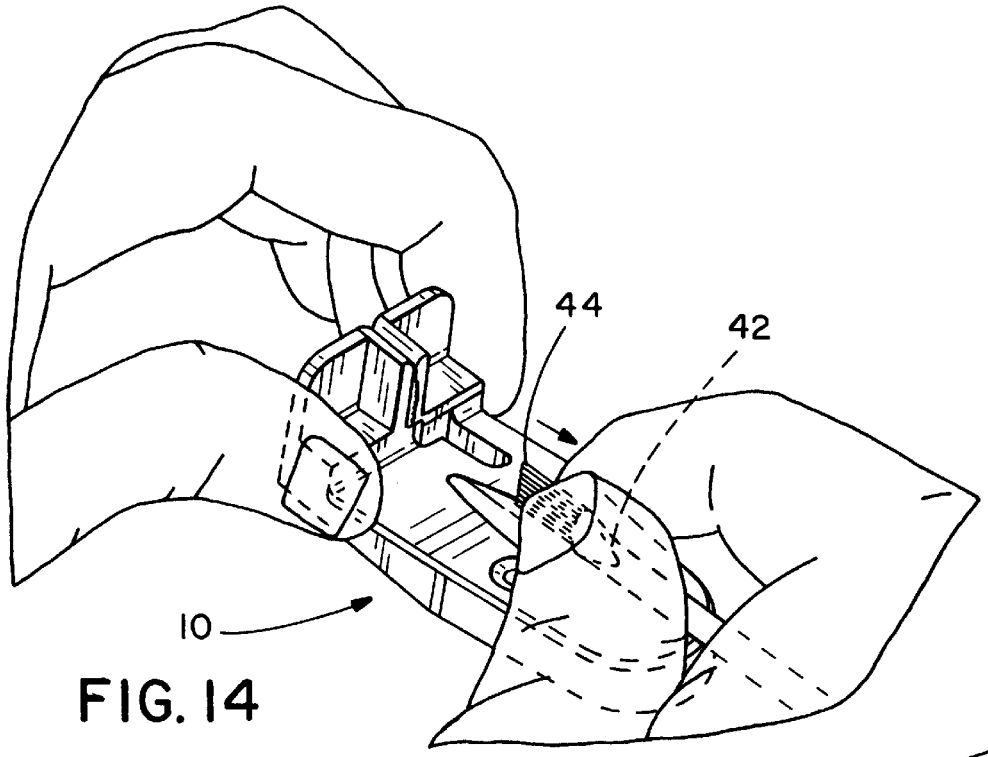
FIG. 14 is a perspective view of the tool operator removing the wires from the wire grooves.
Figure 15:
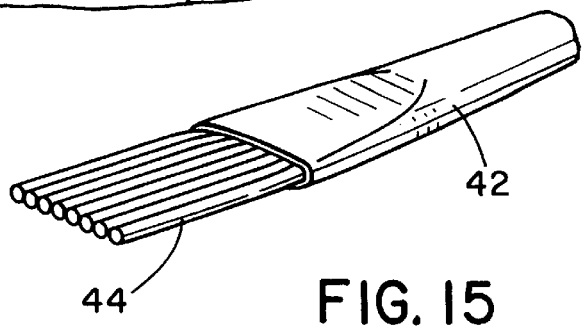
FIG. 15 is a perspective view of the wires after being cut to length.

As seen in FIG. 12, the tool operator, preferably pushes the sheath 42 into the cable guide 22 to positively position the sheath 42 against the axially aligned walls 36 and prohibit any movement. Next, the tool operator may cut the wires 44 to the desired length, which is preferably predetermined by the length of the axially aligned walls 36, thus, the location of the backface 30. As seen in FIG. 13, once the wires 44 have been cut to length, the tool operator inserts his thumb and forefinger into the appropriate finger reliefs 28 to grasp the sheath 42 and wires 44. This too is very important since maintaining the alignment and positioning of the wires during installation is what enables previously impractical field termination of Catagory 5 connectors. Additionally, this step permits the tool operator to maintain and position the twists as close as possible to the end of the individual wires 44. The cable 42 is then withdrawn from the tool, as seen in FIG. 14, for insertion into a Catagory 5 connector and termination therein. As shown in FIG. 15, the wires 44 after removal from the tool 10 are all evenly cut to length and arranged for proper insertion into a Catagory 5 connector with the twists arranged as close as possible to the connector.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A tool comprising, a planar base member;

a pair of projections positioned in an abutting relationship disposed adjacent a distal end of the base member which extend upwardly from the base member;

a pair of walls formed at the distal end of the base member which extend normal from each projection;

a wire path defined between the projections;

a plurality of wire grooves transversely formed below the wire path; and a cable guide formed in the base, axially aligned with the plurality of wire grooves.

2. A tool according to claim 1 wherein, at least one bore extends through the base.

3. A tool according to claim 1 wherein, a spring leg, attached to the base member and one projection, biases one projection toward the other projection when separated.

4. A tool according to claim 1 wherein, finger reliefs are a defined area on the side of each projection bounded by the projection, wall, and base.

5. A wire preparation tool comprising:

a planar base member;

adjacent projections extending upwardly from the base member;

a wire path defined between the projections;

a plurality of wire grooves disposed below the wire path; and means for separating twisted pair wire disposed on the base.

6. A tool according to claim 5 wherein, a cable guide is formed in the base, axially aligned with the plurality of wire grooves.

7. A tool according to claim 5 wherein, at least one bore extends through the base.

8. A tool according to claim 5 wherein, a spring leg, attached to the base member and one projection, biases one projection toward the other projection when separated.

9. A tool according to claim 5 wherein, finger reliefs are formed in the projections.

10. A tool according to claim 5 wherein, means for separating comprises, a separator projection extending from a side of the base.

11. A tool according to claim 10 wherein, means for separating further comprises, a thumb guard extending therefrom so as to cooperate with the separator projection.

12. A method of preparing Category 4 cables for termination in a corresponding connector, comprising the steps of:

removing desired amount of cable sheathing;

separating twisted pair wires;

inserting wires into a wire path of a wire preparation tool;

positioning the wires within wire grooves below the wire path;

pulling the wires axially through the wire grooves until the cable sheathing prohibits further movement;

cutting the wires flush with a backface of the tool;

inserting fingers into finger reliefs; and grasping and removing the cable sheath and wires from the tool.

* * * * *